US007168193B2

(12) United States Patent
Pallas Moreno et al.

(10) Patent No.: US 7,168,193 B2
(45) Date of Patent: Jan. 30, 2007

(54) DEVICE FOR THE COUPLING OF EXCAVATOR TEETH

(75) Inventors: Jorge Pallas Moreno, El Masnou (ES); Javier Pueyo Molina, Barcelona (ES); Fermin Sanchez Guisado, Premia De Mar (ES); Jose Lopez Almendros, Barcelona (ES)

(73) Assignee: Metalogenia Patentes, S.L., Barcelona (ES)

( * ) Notice: Subject to any disclaimer, the term of this patent is extended or adjusted under 35 U.S.C. 154(b) by 240 days.

(21) Appl. No.: 10/773,435

(22) Filed: Feb. 9, 2004

(65) Prior Publication Data

US 2004/0172866 A1 Sep. 9, 2004

Related U.S. Application Data

(60) Division of application No. 10/245,783, filed on Sep. 16, 2002, now Pat. No. 6,836,983, which is a continuation of application No. 09/701,235, filed as application No. PCT/ES99/00160 on Jun. 3, 1999, now Pat. No. 6,745,503.

(51) Int. Cl.
*E02F 9/28* (2006.01)

(52) U.S. Cl. ..... 37/452

(58) Field of Classification Search ..... 37/452, 37/454, 449, 455; 172/753, 772, 772.5; 403/375, 379.2, 379.4
See application file for complete search history.

(56) References Cited

U.S. PATENT DOCUMENTS

| | | | |
|---|---|---|---|
| 247,148 | A | 9/1881 | Anderson |
| 1,775,984 | A | 9/1930 | Younie |
| 2,050,014 | A | 8/1936 | Morrison |
| 2,435,846 | A | 2/1948 | Robertson |
| 2,483,032 | A | 9/1949 | Baer |
| 2,921,391 | A | 1/1960 | Opsahl |
| 3,117,386 | A | 1/1964 | Ferwerda |
| 3,496,658 | A | 2/1970 | Eyolfson |
| 3,520,224 | A | 7/1970 | Hensley et al. |
| 3,574,962 | A | 4/1971 | Smith |
| 3,839,805 | A | 10/1974 | Stepe |
| 3,919,792 | A | 11/1975 | Hahn et al. |

(Continued)

FOREIGN PATENT DOCUMENTS

| | | |
|---|---|---|
| EP | 1 096 073 A1 | 2/2001 |

(Continued)

*Primary Examiner*—Victor Batson
(74) *Attorney, Agent, or Firm*—Sughrue Mion, PLLC

(57) ABSTRACT

The device is characterized in that the nose of the tooth-carrier has a general structure in which two end regions thereof, one corresponding to the area of junction of the said nose with the body of the tooth-carrier and the other to the free end of the tooth-carrier, assume in cross-section a dovetail structure, the dovetail at the first end region being inverted compared to the dovetail at the second end region, the cross-section of the end projection of the nose of the tooth-carrier being constant and the upper face of junction of the said projection with the base of the tooth-carrier assuming a curved structure with the convexity directed outwards, the lateral faces of the nose of the tooth-carrier assuming a structure of flat facets, one of them carrying in proximity to the junction with the body of the tooth-carrier a substantially vertical indentation for the coupling of the retaining cotter pin.

15 Claims, 4 Drawing Sheets

U.S. PATENT DOCUMENTS

| | | | | | |
|---|---|---|---|---|---|
| 4,182,058 | A | | 1/1980 | Poncin | |
| 4,192,089 | A | | 3/1980 | Schwappach | |
| 4,404,760 | A | | 9/1983 | Hahn et al. | |
| 4,414,764 | A | | 11/1983 | Johansson et al. | |
| 4,481,728 | A | * | 11/1984 | Mulder et al. | 37/452 |
| 4,516,340 | A | * | 5/1985 | Launder | 37/457 |
| 4,625,439 | A | | 12/1986 | Johansson et al. | |
| 4,727,663 | A | | 3/1988 | Hahn | |
| 4,799,823 | A | | 1/1989 | Williams | |
| 4,811,505 | A | | 3/1989 | Emrich | |
| 4,965,945 | A | | 10/1990 | Emrich | |
| 5,068,986 | A | | 12/1991 | Jones | |
| 5,088,214 | A | | 2/1992 | Jones | |
| 5,325,615 | A | | 7/1994 | Hutchins et al. | |
| 5,386,653 | A | | 2/1995 | Cornelius | |
| 5,423,138 | A | | 6/1995 | Livesay et al. | |
| 5,456,029 | A | | 10/1995 | Cornelius | |
| 5,469,648 | A | | 11/1995 | Jones et al. | |
| 5,502,905 | A | | 4/1996 | Cornelius et al. | |
| 5,561,925 | A | | 10/1996 | Livesay | |
| 5,617,655 | A | | 4/1997 | Launder et al. | |
| 5,653,048 | A | | 8/1997 | Jones et al. | |
| 5,765,301 | A | | 6/1998 | Clendenning | |
| 5,778,570 | A | | 7/1998 | Eichelberger | |
| 5,802,752 | A | | 9/1998 | Quarfordt | |
| 5,918,391 | A | | 7/1999 | Vinas Peya | |
| 5,987,787 | A | | 11/1999 | Mack | |
| 6,030,143 | A | | 2/2000 | Kreitzberg | |
| 6,047,487 | A | | 4/2000 | Clendenning | |
| 6,240,663 | B1 | | 6/2001 | Robinson | |
| 6,247,255 | B1 | * | 6/2001 | Clendenning | 37/452 |
| 6,321,471 | B2 | | 11/2001 | Fernandez Munoz et al. | |
| 6,477,796 | B1 | | 11/2002 | Cornelius | |
| 6,836,983 | B2 | * | 1/2005 | Pallas Moreno et al. | 37/452 |
| 6,865,828 | B1 | * | 3/2005 | Molino et al. | 37/454 |
| 2001/0001352 | A1 | | 5/2001 | Fernandez Munoz et al. | |

FOREIGN PATENT DOCUMENTS

| | | | |
|---|---|---|---|
| ES | 2 077 412 | T3 | 11/1995 |
| ES | 2 146 174 | A | 7/2000 |
| GB | 1272955 | | 5/1972 |
| WO | WO 92/19822 | A1 | 12/1992 |
| WO | WO 00/01897 | A1 | 1/2000 |

* cited by examiner

I-I

II-II

III-III

IV-IV

V-V

VI-VI

VII-VII

VIII-VIII

IX-IX

DEVICE FOR THE COUPLING OF EXCAVATOR TEETH

RELATED APPLICATIONS

This is a divisional of Application No. 10/245,783, filed Sep. 16, 2002, now U.S. Pat. No. 6,836,983 which is a Continuation Application of U.S. Application Ser. No. 09/701,235, filed Nov. 22, 2000, now U.S. Pat. No. 6,745,03 which is a National Stage Application filed under §371 of PCT Application No. PCT/ES99/00160 filed Jun. 3, 1999; the above noted prior applications are all hereby incorporated by reference.

BACKGROUND OF THE INVENTION

The present invention refers to a device for the coupling of excavator teeth which is applicable to the buckets of excavating machines and, in general, to the active working edges of earth-moving machines of similar types.

Machines for civil engineering work which effect the removal of materials such as earth, rocks, etc., generally have active edges on the so-called buckets of the excavators, which are open receptacles of specific shape fixed to the supporting and travelling gear of the machine and which have the function of removing the mass of earth or earth and more or less loose stones, by means of their front edge, collecting in the bucket the materials which have been loosened, allowing them to be transferred to a vehicle for their transport to another site or simply for depositing the mass of earth and stones which has been removed, for its subsequent replacement, for example, in the case of the opening of a trench.

The buckets of excavators and the like suffer significant problems at the active edge because of the high degree of wear to which it is subjected by contact with the earth and stones, which have very abrasive characteristics. For this reason, it is necessary to equip the active edge of the excavator or similar machine with detachable teeth, which are removable components which bear the greater part of the wear by being in direct contact with the mass of earth and stones, and which are therefore parts which wear out very quickly. Said teeth, which are parts that can be exchanged fairly frequently, must combine characteristics which are to a certain extent contradictory, owing to the fact that, being parts which are changed frequently on excavating machines and the like, their price should be relatively low, so it is necessary to exclude mechanization of the teeth, which should be manufactured simply by casting or forging high strength steel. The other contradictory characteristic lies in the need for the mounting of the tooth on the tooth-carrier located at the active edge of the bucket for excavators or the like to be effected with sufficient adjustment to avoid as far as possible any play between the facing regions of the tooth-carrier and the tooth, since the occurrence, otherwise inevitable, of play in the said region results in an increase in the stresses at specific points of contact between the tooth and the tooth-carrier, which further increase the wear locally, in a process which may end in breakage of the parts and which involves changing the worn part, that is to say, the tooth, more or less frequently, according to how the above-mentioned wear phenomena can be controlled to a greater or lesser degree.

At present, many types of coupling between the teeth of excavators and the tooth-carriers are known, although all of them, given the contradictory conditions to be fulfilled and the hard work to which said components are subjected, exhibit defects with regard to what could be considered an ideal solution in terms of life of the tooth and avoidance of excessive wear on the tooth-carrier, enabling the latter to have an acceptably extended life.

U.S. Pat. No. 5,561,925 refers too a tooth assembly and retaining mechanism in which a nose portion matching with the socket of the tooth has parallel surfaces interconnected by a flat end surface.

U.S. Pat. No. 4,625,439 refers to an excavating tooth retaining means comprising a nose portion in which the tooth is fixed by means of a wedge in which the wear part lands directly against the holder.

However, none of said patents discloses the double inverted dovetail structure which characterizes the present invention.

SUMMARY OF THE INVENTION

In order to obtain an improvement in the characteristics of the couplings for excavator teeth, achieving rapidity of assembly and secure and durable coupling between the tooth and the tooth-carrier, the inventor of the present patent application has carried out investigations and tests which have resulted in a coupling for excavator teeth which has an improved performance in use.

The coupling for excavator teeth and the like which is the subject of the invention is of the type" which has a projection on the front face of the tooth-carrier, directed substantially axially with respect to the longitudinal axis of the tooth-carrier, and in which the cross-section of the tooth coupling region has a cross-section of the tooth coupling region has a cross-section decreasing from the starting region to the free end, being characterized by the combination of the areas of contact between the tooth-carrier and the tooth, and the positioning of the retaining cotter pin, so that a close coupling is obtained between the tooth and the tooth-carrier, giving rise to secure fastening, with many areas of contact between the two coupled components, for the purpose of reducing the local wear and with an arrangement of angles of the areas of contact such that the stresses produced on the tooth tend to produce greater wedging and matching of the tooth with the tooth-carrier. In order to obtain this result, the area coupling the tooth with the tooth-carrier has a structure which is constituted basically by the joining of two reverse dovetail profiles, that is to say, the dovetail at the first end region being inverted compared to the dovetail at the second end region, corresponding to the starting region and the free end or point of the so-called "nose" of the tooth-carrier respectively. This is complemented by a slightly convex structure, above all of the upper area of junction between the base or start of the nose of the tooth-carrier and the end or projection thereof which has a uniform section. The area of junction of the upper curved part of the nose of the tooth-carrier with the base thereof has a narrow flat transverse region. The lateral faces of the nose of the tooth-carrier assume the form of facets, one of them corresponding to the front projection of constant section and another to the lateral faces, which may be flat or gently curved with the convexity towards the outside.

With this arrangement the result is obtained that the nose of the tooth-carrier exhibits a much higher mechanical strength and, above all, in normal operation thereof no stresses are produced which tend to eject the tooth, which constitutes a recurrent problem of the currently known tooth-carriers. In particular, the slightly curved structure, with the convexity directed outwards, of the upper face of the nose of the tooth-carrier permits, in addition to a very efficient coupling between the tooth and the tooth-carrier, an increase in the cross-section of the nose of the tooth-carrier, and therefore a greater mechanical strength on the latter.

The device of the present invention is likewise characterized by a new type of cotter pin for retaining the tooth on the tooth-carrier, which is distinguished by its easy introduction and high resistance to removal, basically comprising a body of the cotter pin of flattened generally parallelepipedal structure, which on one of its intermediate sized faces has a wide rebate to which there is joined, by means of vulcanization of a special rubber, an insert carrying a small lateral projection with rounded transverse edges which is intended to be introduced into a seating of complementary shape of the tooth-carrier after its introduction.

BRIEF DESCRIPTION OF THE DRAWINGS

For greater understanding there are appended, by way of explanatory but non-limiting example, drawings of a preferred embodiment of the present invention.

DETAILED DESCRIPTION OF THE INVENTION

Figure 12:
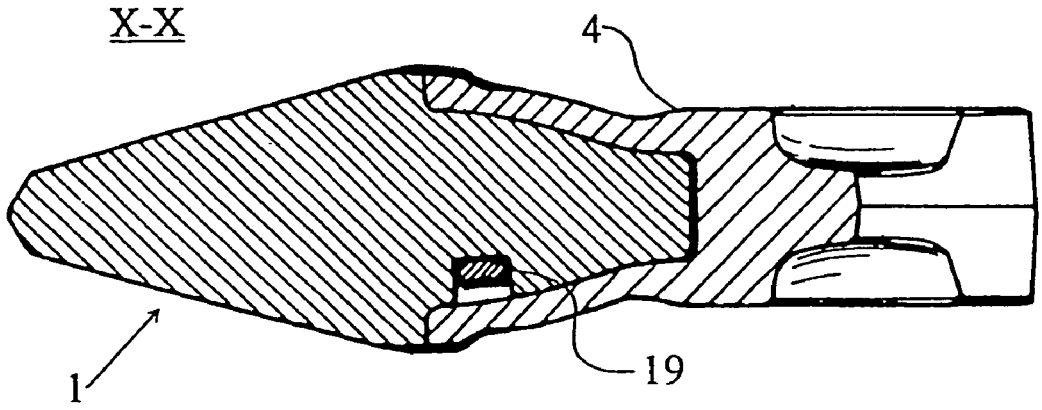
FIGS. 12 and 13 are respective sections through the section planes indicated.
Figure 14:
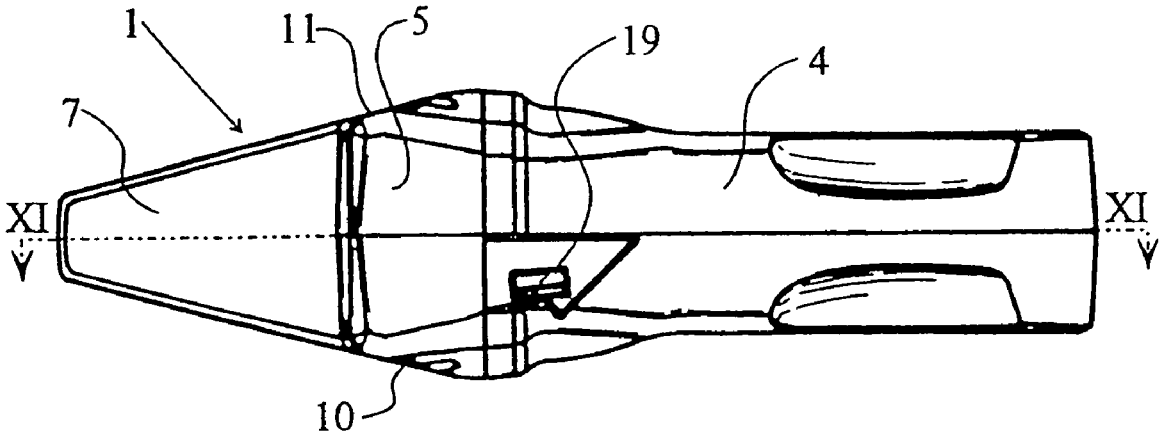
FIG. 14 is a plan view of the assembly of tooth and tooth-carrier.
Figure 15:
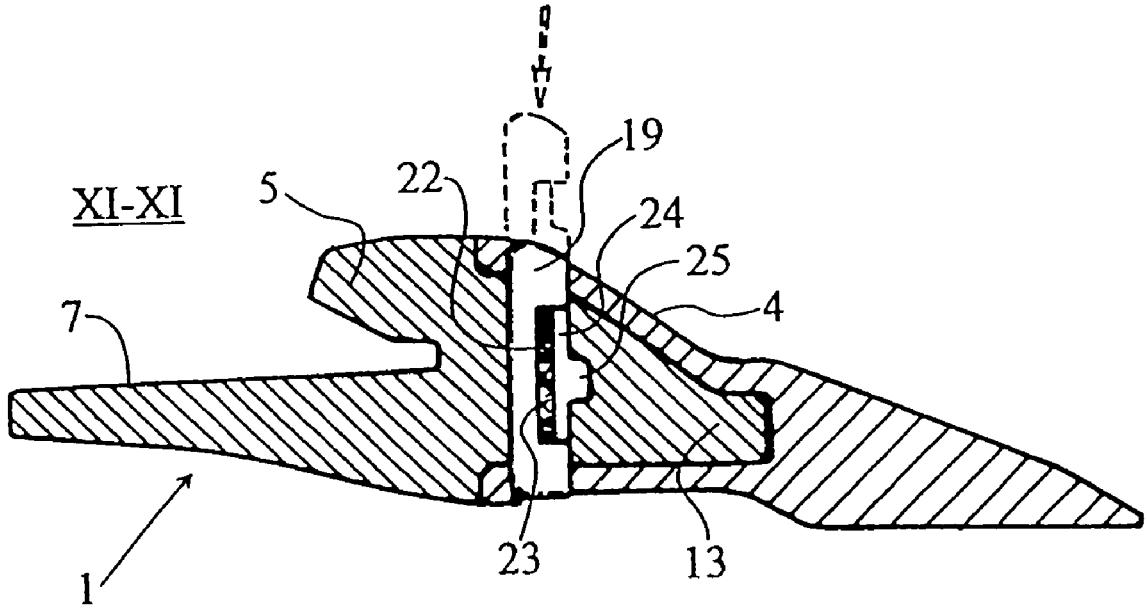
FIG. 15 is a longitudinal section in a vertical plane of the assembly of tooth and tooth-carrier as indicated.
Figure 16:
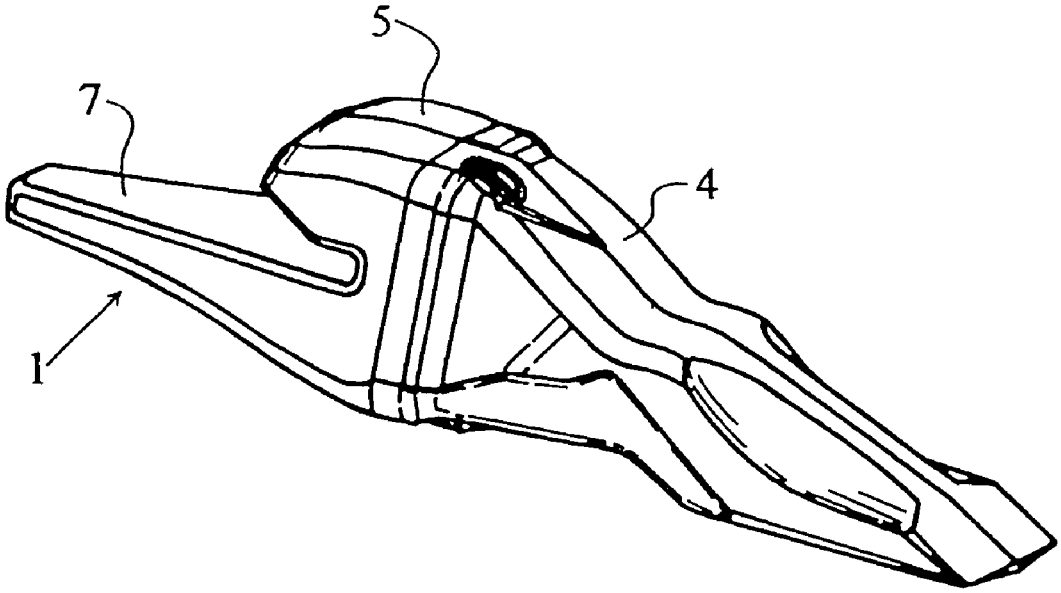
FIG. 16 is a perspective view of the assembly of tooth and tooth-carrier when assembled.

As shown in the FIG., the coupling for excavator teeth which is the subject of the present invention has a fork-like part 1 intended for coupling with the edge of the excavator bucket and a region 2 that projects from the rear face 3 of the region 1 and is intended to receive the excavator tooth, indicated by 4 in FIGS. 12 and 14 and in FIGS. 15 and 16.

The region 1 for the coupling of the excavator to the bucket is fork-shaped with an upper arm 5 and a lower arm 6 which are separated by an indentation defined by flat areas 7 and 8 intended to receive the edge of the excavator bucket and which in plan have sections decreasing from the rear face 3 of the region 1 to the free end 9, the upper arm 5 also having flat lateral faces 10 and 11.

Figure 13:
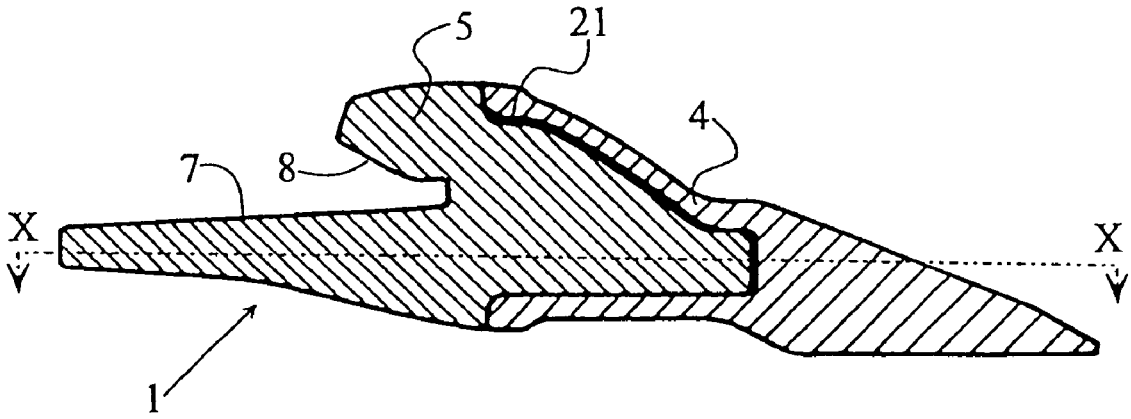

The tooth coupling projection 2 has a combination of successive regions, which is basically defined, as will be seen in FIGS. 3 to 11, by a structure constituted basically by two inverted dovetails or trapezoids. That is to say, the dovetail or trapezoid at the first end region is inverted compared to the dovetail, or trapezoid at the second starting area 12 of the projection and to the end 13 of the projection 14 of the tooth-carrier, which correspondingly are complementary to the cavity of the tooth 4, as shown in FIGS. 12, 13 and 15. The said projection 14, as shown by the sections provided, has a constant section throughout is length. For this reason, the lateral faces of the nose of the tooth-carrier 2 have a structure substantially formed by two facets gently differentiated so that one of the laterals corresponds respectively to the face 15 of the body of the nose of the tooth-carrier and the flat face 16 of the termination of constant section 14. The other lateral 17 has similar characteristics, having a wide indentation in a substantially vertical arrangement 18, which is intended to receive the cotter pin 19, which has been shown in greater detail in FIG. 15.

Figure 1:
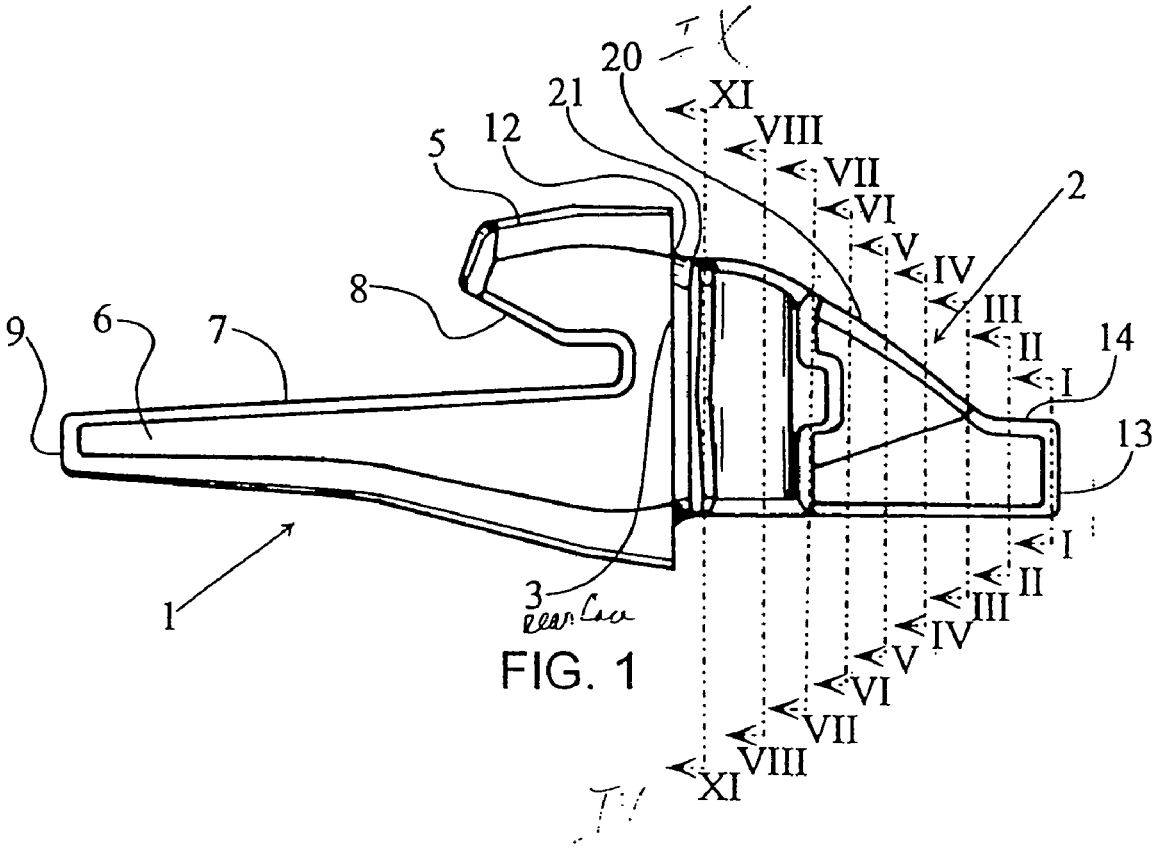
FIGS. 1 and 2 are views in elevation and in plan, respectively, of a tooth-carrier produced according to the present invention.
Figure 2:
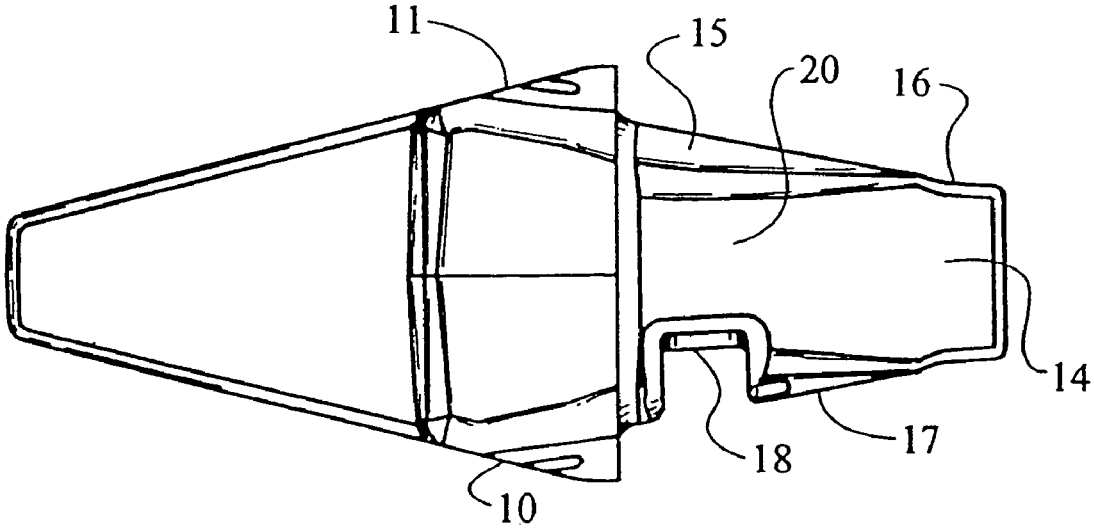
Figure 3:
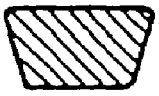
FIGS. 3 to 11 are sectional views through the section planes indicated in FIG. 1.
Figure 4:
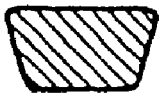
Figure 5:
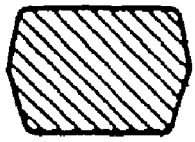
Figure 6:
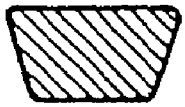
Figure 7:
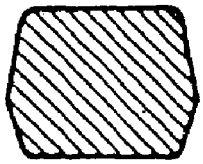
Figure 8:
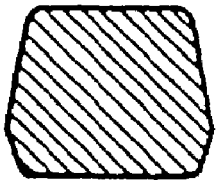
Figure 9:
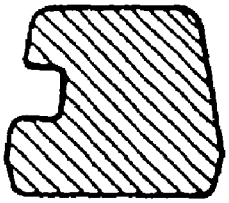
Figure 10:
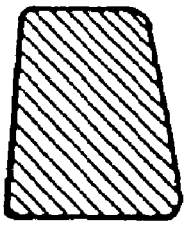
Figure 11:
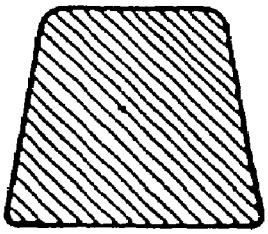

The upper face 20 of the nose of the tooth-carrier has a generally curved shape with the convexity directed outwards, joining the inner end of the projection 14 to the body 1 of the tooth-carrier by, means of a small flat area in the area of junction with the said body indicated by 21 in FIG. 1 and also in FIG. 13.

The lateral faces 15 and 17 may be flat or curved, with the convexity directed outwards.

The construction of the nose of the tooth-carrier with the shape indicated makes it possible to obtain a much higher strength thereon, at the same time eliminating the reactions of ejection of the tooth which customarily occur in the currently known mountings for excavator teeth.

As will be observed in FIGS. 12 and 15, the cotter pin 19 has a flattened straight, generally parallelepipedal structure, having on one of its minor sides a wide indentation 22 in which, by means of a vulcanized coating 23, there is effected the joining of a straight insert 24, carrying a lateral projection 25, provided with rounded edges, which is engaged in a recess of complementary shape of the nose of the tooth-carrier.

This arrangement of the cotter pin therefore makes possible both its easy introduction by axial compression in its groove and sufficient retention thereof in the nose of the tooth-carrier. Withdrawal is also facilitated by the existence of the joining part of vulcanized rubber.

By means of the arrangement which has been explained, the coupling device for excavator teeth which is the subject of the present invention makes it possible to fit the tooth with minimum play in all the coupling areas, as well as allowing numerous areas of contact in order to reduce local wear, and reduces the force components to the direction of ejection of the tooth with respect to the tooth-carrier.

As it is obvious, this invention will cover the tooth holder as well as the tooth to be adapted to the same, which will have a form which is conjugated to the form of the mating tube holder, with cavities to receive the coupling device.

The characteristics of the cotter pin are also very advantageous, both as regards the ease of assembly and disassembly of the cotter pin and as regards the high holding force thereof.

What is claimed is:

1. A device for coupling teeth comprising:

a tooth defining a cavity;

a fork like part;

a projecting portion having a starting area, a projection, a top, a bottom and a free end, said projecting portion decreasing in cross-sectional area from said starting area to said free end, said projecting portion being disposed at least partly within said tooth cavity, and wherein said starting area is connected to said fork-like part, said starting area and said projection comprising:

a parallel trapezoid in cross section, each having a long parallel side and a short parallel side, wherein said long parallel side of said starting area is disposed on said bottom of said projecting portion and said long parallel side of said projection being disposed on said top of said projecting portion.

2. The device according to claim 1, wherein the distance between said long parallel side and said short parallel side of said starting area is larger than the distance between said long parallel side and said short parallel side of said projection.

3. The device according to claim 1, wherein said top of said projecting portion defines an upper plane, and said short parallel side of said starting area extends to said upper plane.

4. The device according to claim 1, wherein said bottom of said projecting portion defines a lower plane and said long parallel side of said starting area extends to said lower plane, and said short parallel side of said projection extends to said lower plane.

5. The device according to claim 1, wherein said cross section of said projecting portion remains substantially constant between said projection and said free end.

6. The device according to claim 1, wherein said projecting portion further comprises:

an upper face connecting said short parallel side of said starting area to said long parallel side of said projection, said upper face having a convex shape.

7. The device according to claim 1, wherein said projecting portion further comprises:

a lower face connecting said long parallel side of said starting area to said short parallel side of said projection, said lower face having a substantially flat shape.

8. The device according to claim 1, wherein said projecting portion further comprises:

a plurality of lateral sides having substantially flat surfaces sloping from said starting area to said projection.

9. The device according to claim 8, wherein at least one of said lateral sides of said projecting portion comprises:

a recess for receiving a retention pin, that engages said tooth to affix said tooth in a desired position.

10. The device according to claim 9, wherein said recess extends substantially from said bottom of said projecting portion to said top of said projecting portion.

11. The device according to claim 9, wherein said recess further comprises:

a widened region at a distance from said top of said projecting portion, and wherein said retention pin further comprises:

a locking member projecting transversely from said retention pin, said widened region being adapted to receive said locking member of said retention pin.

12. The device according to claim 1, in which said fork-like part further comprises:

a rear face circumscribing said projecting portion and limiting said projecting portion from said fork-like part.

13. A system for an interlocking tooth and carrier comprising:

a tooth defining a cavity;

a fork like part;

a projecting portion having a starting area, a projection, a top, a bottom and a free end, said projecting portion decreasing in cross-sectional area from said starting area to said free end, said projecting portion being disposed at least partly within said tooth cavity, and wherein said starting area is connected to said fork-like part, said starting area and said projection comprising:

a parallel trapezoid in cross section, each having a long parallel side, wherein said long parallel side of said starting area is disposed on said bottom of said projecting portion and said long parallel side of the projection being disposed on said top of said projecting portion; said cavity further comprising:

a top, a bottom, a mouth and an inner end, said cavity decreasing in crooss-sectional area from said mouth to said inner end and said projecting portion being disposed at least partly within said tooth cavity, said mouth and said inner end comprising:

a parallel trapezoid in cross section, each having a long parallel side and a short parallel side, wherein said long parallel side of said mouth is disposed on said bottom of said cavity and said long parallel side of said inner end is disposed on said top of said cavity.

14. The device according to claim 2, wherein said top of said projecting portion defines an upper plane and said short parallel side of said starting area extends to said upper plane.

15. The device according to claim 10, wherein said recess further comprises:

a widened region at a distance from said top of said projecting portion, said retention pin further comprising:

a locking member projecting transversely from said retention pin, wherein said widened region is adapted for receiving said locking member of said retention pin.

* * * * *